US007926566B2

(12) United States Patent
Palmer

(10) Patent No.: US 7,926,566 B2
(45) Date of Patent: Apr. 19, 2011

(54) METHOD OF MAKING A DOWNHOLE CUTTING TOOL, USING A SINGLE PIECE TUBULAR WITH A RADIALLY DISPLACEABLE PORTION

(75) Inventor: Larry T. Palmer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/609,654

(22) Filed: Oct. 30, 2009

(65) Prior Publication Data

US 2010/0043602 A1 Feb. 25, 2010

Related U.S. Application Data

(62) Division of application No. 11/671,181, filed on Feb. 5, 2007, now Pat. No. 7,635,021.

(51) Int. Cl.
*E21B 29/00* (2006.01)
*E21B 43/11* (2006.01)

(52) U.S. Cl. ..... 166/297; 166/55

(58) Field of Classification Search ..... 30/106, 30/103, 92; 72/338; 166/297, 55
See application file for complete search history.

(56) References Cited

U.S. PATENT DOCUMENTS

| | | | |
|---|---|---|---|
| 5,456,312 | A | 10/1995 | Lynde et al. |
| 5,732,770 | A | 3/1998 | Beeman |
| 6,164,377 | A | 12/2000 | Roberts |
| 6,896,049 | B2 | 5/2005 | Moyes |
| 6,899,181 | B2 | 5/2005 | Simpson et al. |

OTHER PUBLICATIONS

Downhole Electric Cutting Tool (DECT001), Pipe Recovery, Sondex, www.sondex.com, May 2006; 2 pages.
Leading Oilfield Technology, SON-7560, Sondex, www.sondex.com; Jun. 2007; 20 pages.

*Primary Examiner* — David J Bagnell
*Assistant Examiner* — Cathleen R Hutchins
(74) *Attorney, Agent, or Firm* — Cantor Colburn LLP

(57) ABSTRACT

Disclosed herein relates to a single piece tubular member. The tubular member having a non-radially displaceable portion and a radially displaceable portion, the radially displaceable portion being movable to a position of similar radial displacement as that of the non-radially displaceable portion and a position of relatively large radial displacement in comparison to the non-radially displaceable portion. The tubular member also having at least one cutting arrangement disposed at the radially displaceable portion.

14 Claims, 5 Drawing Sheets

METHOD OF MAKING A DOWNHOLE CUTTING TOOL, USING A SINGLE PIECE TUBULAR WITH A RADIALLY DISPLACEABLE PORTION

CROSS REFERENCE TO RELATED APPLICATION

This application is a divisional application of U.S. Ser. No. 11/671,181, filed Feb. 5, 2007, the contents of which are incorporated by reference herein in their entirety.

BACKGROUND OF THE INVENTION

For a variety of reasons there are occasions when tubular structures such as casings and production tubing, for example, positioned downhole in wellbores need to be cut. Some examples are for removal of a damaged section of tubing or to provide a window for diagonal drilling.

Cutters have been developed that have rotating portions with knives that are pivoted radially outwardly to engage the inner surface of the tubular structure to perform a cut. Such cutters have a multitude of pivoting joints, cams and actuators that interact to rotate the knives between the noncutting and cutting configurations. The complexity of such cutters increases fabrication costs and potential failure modes.

Accordingly, the art is in need of less complex cutting tools.

BRIEF DESCRIPTION OF THE INVENTION

Disclosed herein relates to a single piece tubular member. The tubular member having a non-radially displaceable portion and a radially displaceable portion, the radially displaceable portion being movable to a position of similar radial displacement as that of the non-radially displaceable portion and a position of relatively large radial displacement in comparison to the non-radially displaceable portion. The tubular member also having at least one cutting arrangement disposed at the radially displaceable portion.

Further disclosed herein relates to a cutting tool. The cutting tool having a deformable tubular member having an inside surface and an outside surface and a plurality of lines of weakness thereat. At least one of the lines of weakness being positioned closer to one of the outside surface and the inside surface and at least one other of the plurality of lines of weakness being positioned closer to the other of the outside surface and the inside surface. The cutting tool also having at least one cutting element disposed at a portion of the tubular member most radially displaceable from an undeformed position of the tubular member.

Further disclosed herein relates to a method of cutting a downhole tubular. The method includes delivering a tubular cutting tool, with a plurality of lines of weakness thereon, to a downhole position within a downhole tubular that is to be cut, rotating the tubular cutting tool, and actuating the tubular cutting tool. The actuating causing a radially deformable portion of the tubular cutting tool to radially deform compared to an unactuated position of the tubular cutting tool. The actuating also causing a cutting element attached to the radially deformable portion to contact a downhole tubular to be cut.

Further disclosed herein relates to a method for making a cutting tool. The method includes configuring a deformable tubular member with a plurality of lines of weakness, with at least one of the plurality of lines of weakness disposed at each of an inside dimension and an outside dimension of the tubular member. The method also includes locating the plurality of lines of weakness relative to each other to facilitate deforming a portion of the tubular member to a greater radial dimension than the undeformed tubular member, and locating a cutting arrangement on the portion.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
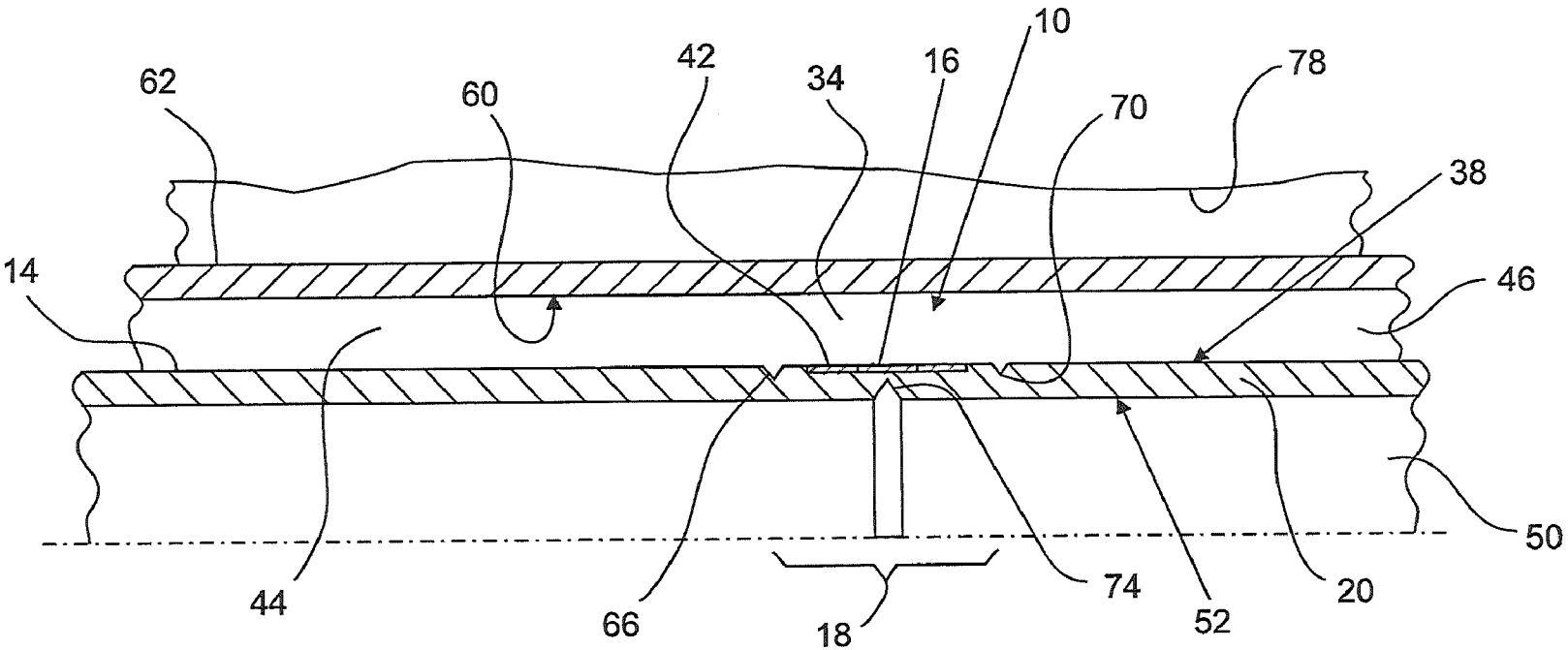
FIG. 1 depicts a partial cross sectional view of a cutting tool disclosed herein in an unactuated configuration.
Figure 2:
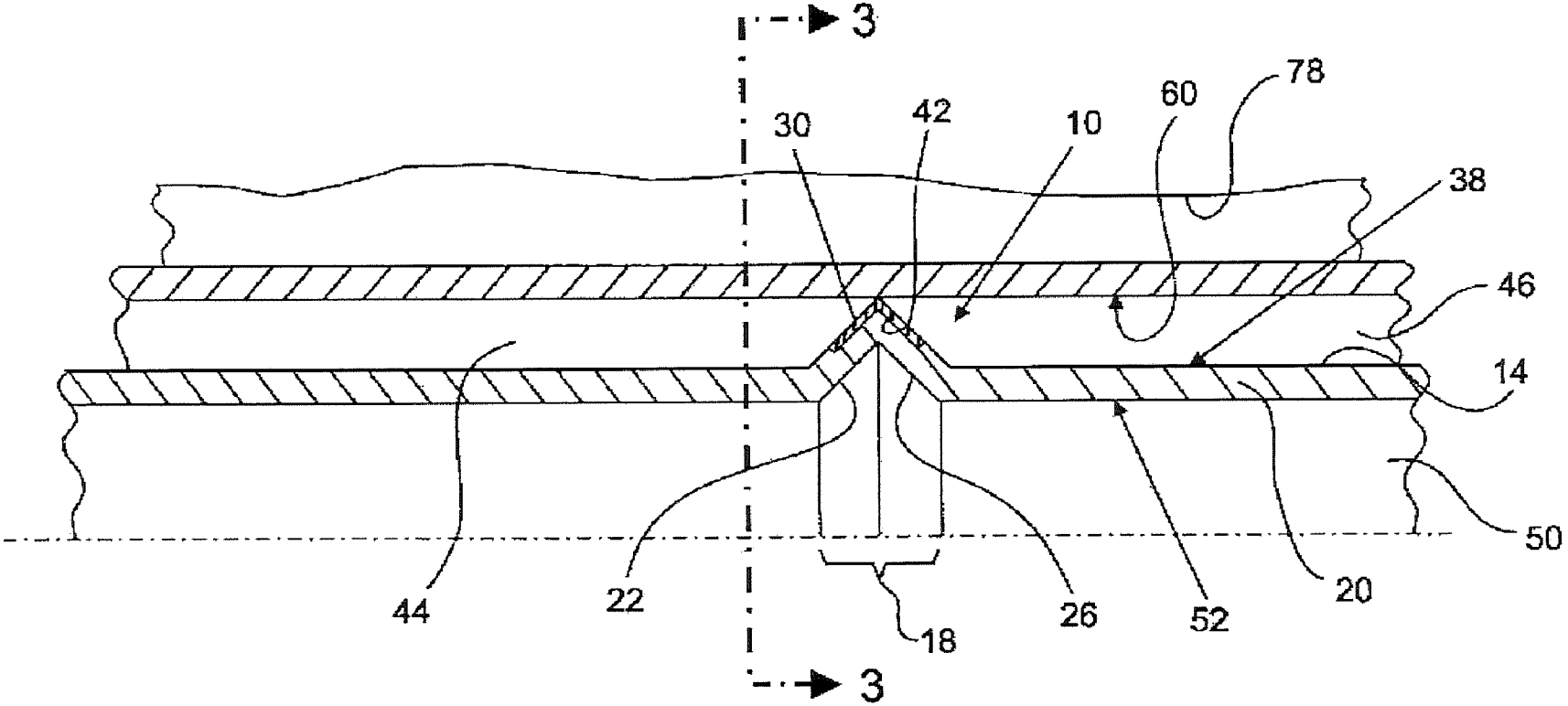
FIG. 2 depicts a partial cross sectional view of the cutting tool of FIG. 1 in an actuated configuration.

Referring to FIGS. 1 and 2, a partial cross sectional view of an embodiment of the cutting tool 10 is illustrated. The cutting tool 10 includes a tubular member 14 that has a radially displaceable portion 18 and a non-radially displaceable portion 20. As illustrated in FIG. 1 the radially displaceable portion 18 is in an unactuated configuration and as illustrated in FIG. 2 the radially displaceable portion 18 is in an actuated configuration. In the actuated configuration the radially displaceable portion 18 forms two frustoconical sections 22 and 26. The greatest radial deformation 30 of the tubular member 14 occurs where the two frustoconical sections 22 and 26 meet. Thus, an annular flow area 34 is defined by the greatest radial deformation 30 and an outside surface 38 of the non-radially displaceable portion 20. At least one axial groove 42 in the outside surface 38 forms a first fluid passage through which fluid can flow between an uphole annular area 44 and a downhole annular area 46 when the radially displaceable portion 18 is in the actuated configuration. A second fluid passage 50 is formed through the center of the tubular member 14 defined by an inside surface 52 of the tubular member 14.

The greatest radial deformation 30 contacts an inner surface 60 of a tubular structure 62 that is to be cut by the cutting tool 10. A cutting arrangement positioned at the greatest radial deformation 30 engages with and cuts through the tubular structure 62. The cutting arrangement can include a hardened portion of the metal of which the tubular member 14 is made, which can include sharpened portions of the metal, for example. Alternately the cutting arrangement can include an insert 16 of another material into the tubular member 14. A cutting arrangement insert 16 can be made of such materials as tungsten carbide or diamonds, for example, which can be used separately or in combination.

The radially displaceable portion 18 is reconfigurable between the unactuated configuration and the actuated configuration. In the unactuated configuration the frustoconical sections 22 and 26 are configured as cylindrical components having roughly the same inside dimension as the tubular member 14 in the uphole annular area 44 and a downhole annular area 46. Reconfiguration from the unactuated to the actuated configuration is effected, in one embodiment, by the application of an axial compressive load on the tubular member 14. Conversely, reconfiguration from the actuated to the unactuated configuration is effected by the application of an axial tensile load on the tubular member 14.

Reconfigurability of the radially displaceable portion 18 between the actuated configuration and the unactuated configuration is due to the construction thereof. The radially displaceable portion 18 is formed from a section of the tubular member 14 that has three lines of weakness, specifically located both axially of the tubular member 14 and with respect to the inside surface 52 and the outside surface 38 of the tubular member 14. In one embodiment, a first line of weakness 66 and a second line of weakness 70 are defined in this embodiment by diametrical grooves formed in the outside surface 38 of the tubular member 14. A third line of weakness 74 is defined in this embodiment by a diametrical groove formed in the inside surface 52 of the tubular member 14. The three lines of weakness 66, 70 and 74 each encourage local deformation of the tubular member 14 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The three lines of weakness 66, 70 and 74 together encourage deformation of the tubular member 14 in a manner that creates a feature such as the radially displaceable portion 18. The feature is created, then, upon the application of an axially directed mechanical compression of the tubular member 14 such that the radially displaceable portion 18 is actuated as the tubular member 14 is compressed to a shorter overall length. Other mechanisms can alternatively be employed to actuate the tubular member 14 between the unactuated relatively cylindrical configuration and the actuated configuration presenting the frustoconical sections 22 and 26. For example, the tubular member 14 may be reconfigured to the actuated configuration by diametrically pressurizing the tubular member 14 about the inside surface 52 in the radially displaceable portion 18.

Figure 3:
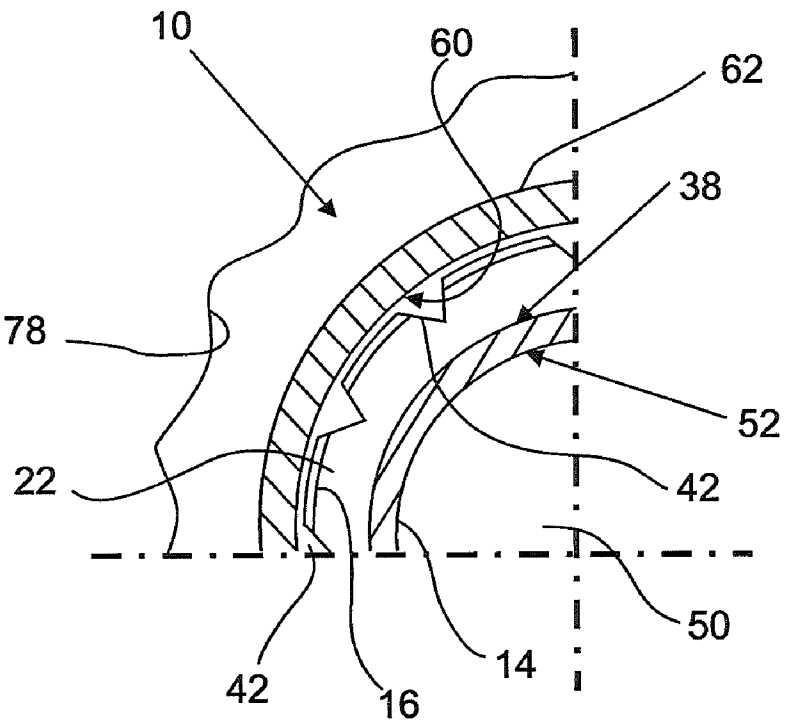
FIG. 3 depicts a partial cross sectional view of the cutting tool of FIG. 2 taken at arrows 3-3.

Referring to FIG. 3, a cross sectional view of the cutting tool 10 of FIG. 2 is shown taken at arrows 3-3. The fluid passages between the cutting tool 10 and the inside surface 52, of the tubular structure 60, created by the axial grooves 42, is illustrated. Although the axial grooves 42 are illustrated herein as V-shaped, it should be appreciated that alternate embodiments can have grooves of any shape. It should also be noted that in alternate embodiments the cutting tool 10 could be used to cut through any downhole tubular structure such as a casing 78 for example.

Figure 4:
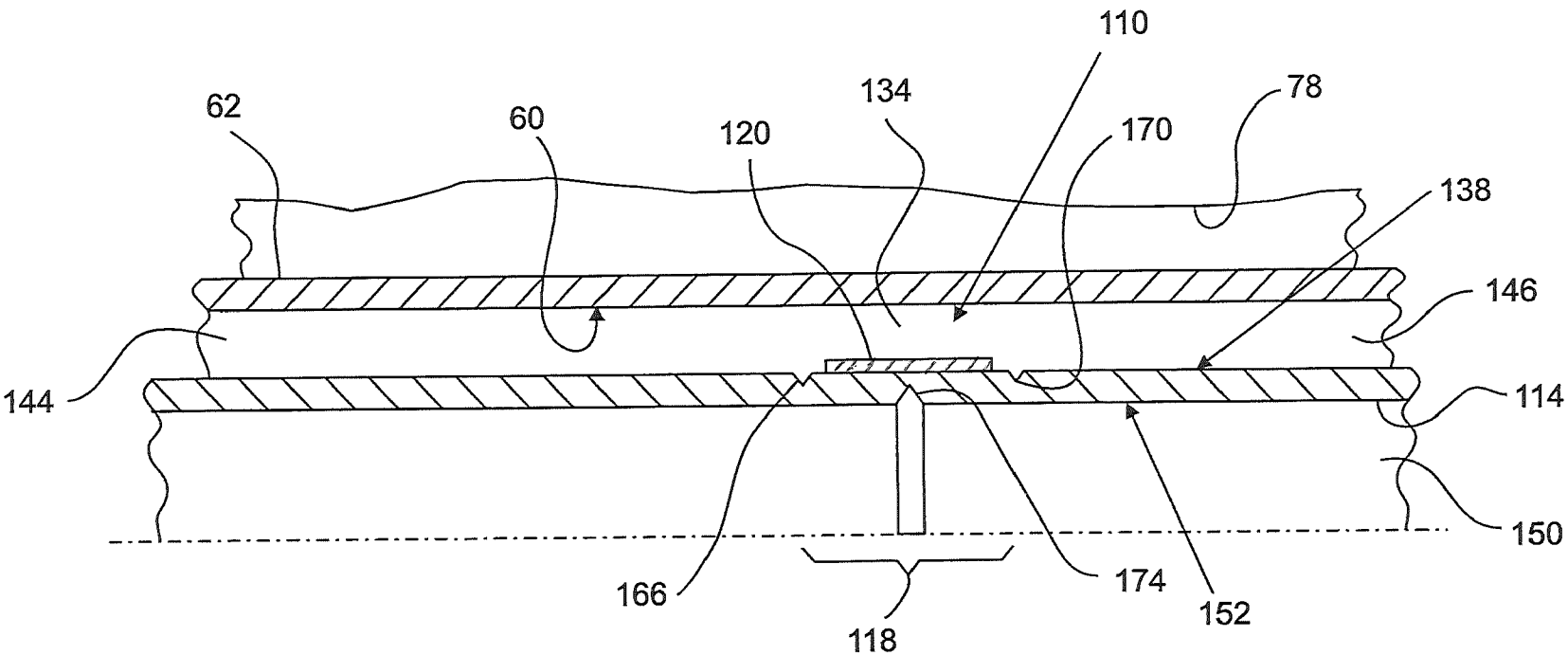
FIG. 4 depicts a partial cross sectional view of another embodiment of a cutting tool disclosed herein in an unactuated configuration.
Figure 5:
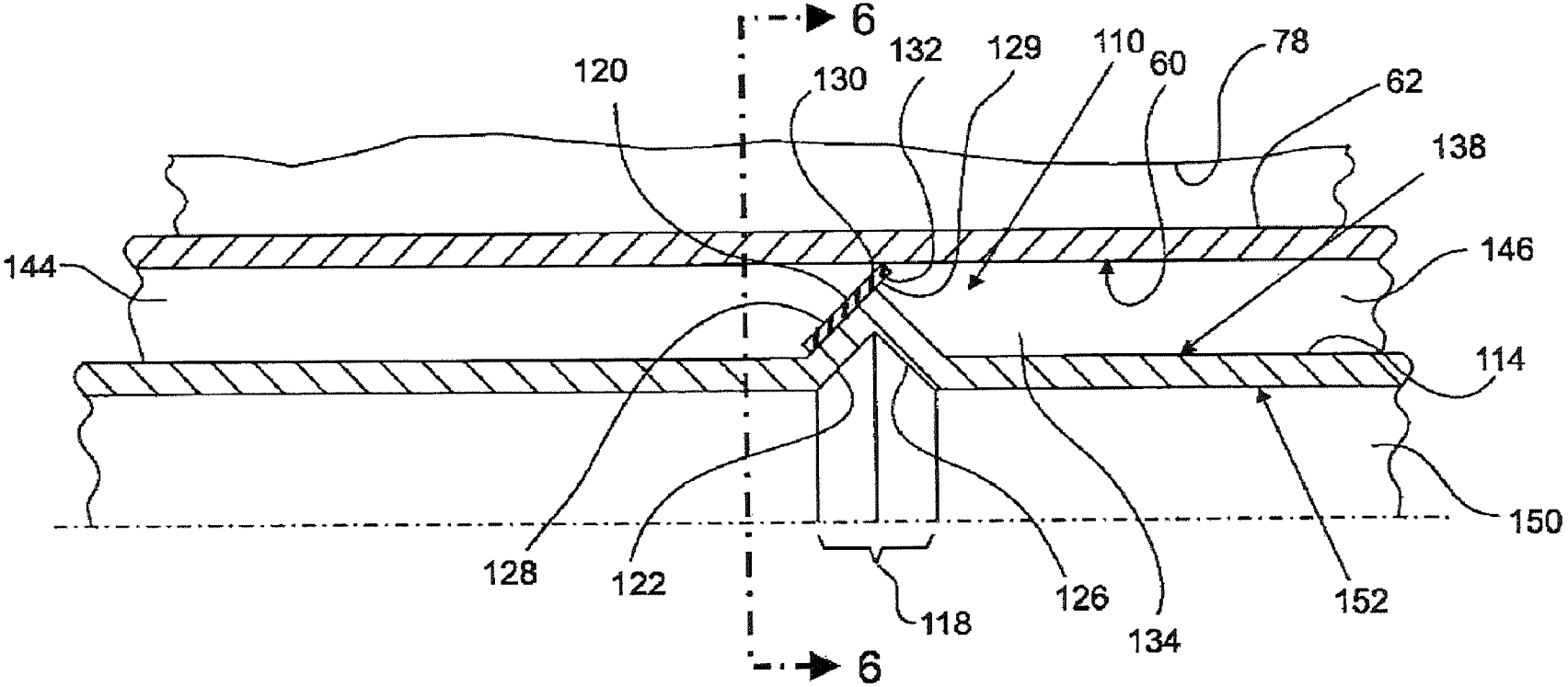
FIG. 5 depicts a partial cross sectional view of the cutting tool of FIG. 4 in an actuated configuration.

Referring to FIGS. 4 and 5, an alternate exemplary embodiment of the cutting tool 110 is illustrated. The cutting tool 110 includes a tubular member 114 and a radially displaceable portion 118. The radially displaceable portion 118 includes a plurality of extension members 120 attached thereto. As illustrated in FIG. 4 the radially displaceable portion 118 is in an unactuated configuration and as illustrated in FIG. 5 the radially displaceable portion 118 is in an actuated configuration. In the actuated configuration the radially displaceable portion 118 forms two frustoconical sections 122 and 126. The extension members 120 are fixedly attached to the first frustoconical section 122 at a first portion 128. A second portion 129 of the extension members 120 is positioned radially outwardly of the second frustoconical section 126 but is not attached to the second frustoconical section 126. As such when the radially displaceable portion 118 is actuated the extension members 120 remain substantially parallel to the first frustoconical section 122 causing the second portion 129 of the extension members 120 to extend radially outwardly of the outermost portion of the frustoconical members 122, 126. As such the greatest radial deformation 130 of the cutting tool 110 occurs at an end 132 of each of the extension members 120. Control of the relationship of the greatest radial deformation 130 to the radial dimension of the end 132 in the unactuated configuration is completely controllable by setting the lengths of the second portions 129. An annular flow area 134 is defined by the greatest radial deformation 130 and an outside surface 138 of a non-radially displaceable portion 140. At least one axial space 142 between adjacent extension members 120 forms a first fluid passage through which fluid can flow between an uphole annular area 144 and a downhole annular area 146 when the centralizer 110 is in the actuated configuration. A second fluid passage 150 is formed through the center of the tubular member 114 defined by the inside surface 162 in the outside surface 138 forms a first fluid passage through which fluid can flow between an uphole annular area 144 and a downhole annular area 146 when the radially displaceable portion 118 is in the actuated configuration. A second fluid passage 150 is formed through the center of the tubular member 114 defined by an inside surface 152 of the tubular member 114.

The greatest radial deformation 130 contacts an inner surface 60 of a tubular structure 62 that is to be cut by the cutting tool 110. A cutting arrangement positioned at the greatest radial deformation 130 of the extension members 120 engages with and cuts through the tubular structure 62. The cutting arrangement can include a hardened portion of the metal from which the extension members 120 are made. Alternately the cutting arrangement can include an insert of another material into the extension members 120. A cutting arrangement insert can be made of such materials as tungsten carbide or diamonds, for example, which can be used separately or in combination.

The radially displaceable portion 118 is reconfigurable between the unactuated configuration and the actuated configuration. In the unactuated configuration the frustoconical sections 122 and 126 are configured as cylindrical components having roughly the same inside dimension as the tubular member 114 in the uphole annular area 144 and a downhole annular area 146. Reconfiguration from the unactuated to the actuated configuration is effected, in one embodiment, by the application of an axial compressive load on the tubular member 114. Conversely, reconfiguration from the actuated to the unactuated configuration is effected by the application of an axial tensile load on the tubular member 114.

Reconfigurability of the radially displaceable portion 118 between the actuated configuration and the unactuated configuration is due to the construction thereof. The radially displaceable portion 118 is formed from a section of the tubular member 114 that has three lines of weakness, specifically located both axially of the tubular member 114 and with respect to the inside surface 152 and the outside surface 138 of the tubular member 114. In one embodiment, a first line of weakness 166 and a second line of weakness 170 are defined in this embodiment by diametrical grooves formed in the outside surface 138 of the tubular member 114. A third line of weakness 174 is defined in this embodiment by a diametrical groove formed in the inside surface 152 of the tubular member 114. The three lines of weakness 166, 170 and 174 each encourage local deformation of the tubular member 114 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The three lines of weakness 166, 170 and 174 together encourage deformation of the tubular member 114 in a manner that creates a feature such as the radially displaceable portion 118. The feature is created, then, upon the application of an axially directed mechanical compression of the tubular member 114 such that the radially displaceable portion 118 is actuated as the tubular member 114 is compressed to a shorter overall length. Other mechanisms can alternatively be employed to actuate the tubular member 114 between the unactuated relatively cylindrical configuration and the actuated configuration presenting the frustoconical sections 122 and 126. For example, the tubular member may be reconfigured to the actuated configuration by diametrically pressurizing the tubular member 114 about the inside surface 152 in the radially displaceable portion 118.

Figure 6:
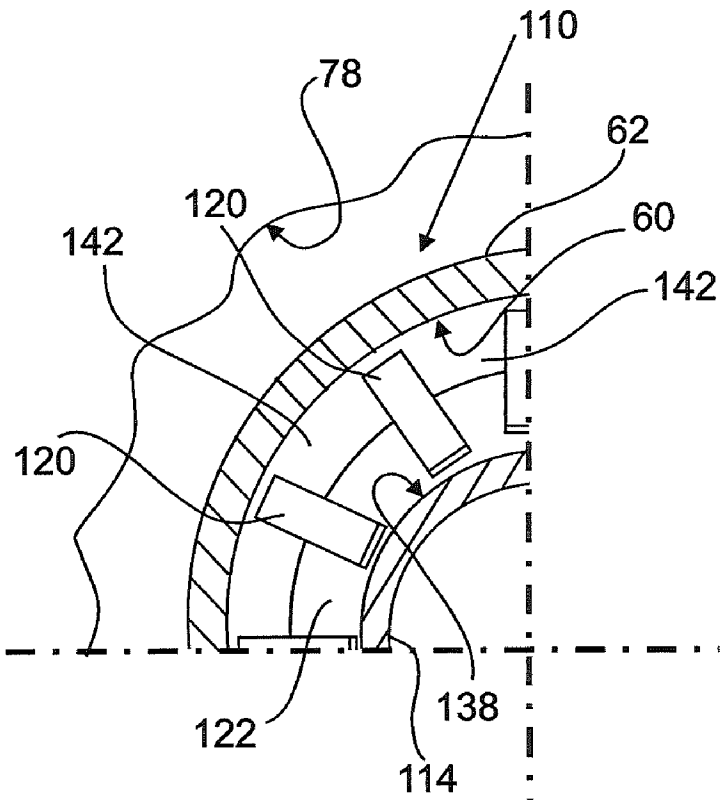
FIG. 6 depicts a partial cross sectional view of the cutting tool of FIG. 5 taken at arrows 6-6.

Referring to FIG. 6, a cross sectional view of the cutting tool 110 of FIG. 5 is shown taken at arrows 6-6. The fluid passages between the cutting tool 110 and the inside surface 60, of the tubular structure 62, created by the axial spaces 142 between the extension members 120, is illustrated. Although the extension members 120 depicted herein are rectangular prisms, it should be noted that alternate embodiments could have extension members of any shape. It should also be noted that in alternate embodiments the cutting tool 110 could be used to cut through any downhole tubular structure such as a casing 78 for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed:

1. A method of making a cutting tool, comprising:

configuring a deformable tubular member with a plurality of lines of weakness, at least one of the plurality of lines of weakness disposed at each of an inside dimension of the deformable tubular member and an outside dimension of the deformable tubular member;

locating the plurality of lines of weakness relative to each other to facilitate deforming a portion of the deformable tubular member to a greater radial dimension than a greatest radial dimension of the deformable tubular member when in an undeformed position; and locating a cutting arrangement on the portion.

2. The method of making a cutting tool of claim 1, further comprising locating two of the plurality of lines of weakness being at the outside dimension of the deformable tubular member and one of the plurality of lines of weakness at the inside dimension of the deformable tubular member.

3. The method of making a cutting tool of claim 2, further comprising locating the one of the plurality of lines of weakness at the inside dimension longitudinally between the two of the plurality of lines of weakness at the outside dimension.

4. The method of making a cutting tool of claim 1, further comprising reducing a wall thickness of the deformable tubular member at the lines of weakness.

5. The method of making a cutting tool of claim 1, further comprising configuring the deformable tubular member to form two frustoconical sections when deformed.

6. The method of making a cutting tool of claim 5, wherein the two frustoconical sections are longitudinally adjacent the portion.

7. The method of making a cutting tool of claim 1, further comprising maintaining fluidic isolation between the inside dimension and the outside dimension.

8. The method of making a cutting tool of claim 1, further comprising reducing a wall thickness of the portion to maintain a fluid passageway between the portion and a downhole structure cuttable by the cutting tool.

9. The method of making a cutting tool of claim 1, wherein the locating the cutting arrangement further comprises attaching an alternate material to the deformable tubular member.

10. The method of making a cutting tool of claim 1, further comprising locating at least one extension member to the deformable tubular member such that a percentage of the at least one extension member extends to a greater radial dimension than the portion when the deformable tubular member is in a deformed position.

11. The method of making a cutting tool of claim 10, further comprising hardening a radially extendable portion of the at least one extension member.

12. The method of making a cutting tool of claim 10, further comprising inserting an alternate material at a radially extendable portion of the at least one extension member.

13. The method of making a cutting tool of claim 1, further comprising configuring the plurality of lines of weakness to facilitate deformation of the portion in response to axial compression of the deformable tubular member.

14. The method of making a cutting tool of claim 1, further comprising configuring the deformable tubular member to return the portion to its original radial dimension after having been deformed to a greater radial dimension upon an axial tensile load applied to the deformable tubular member.

* * * * *